US008574023B2

(12) United States Patent
Schmid et al.

(10) Patent No.: US 8,574,023 B2
(45) Date of Patent: Nov. 5, 2013

(54) TOY VEHICLE TRACK SET

(75) Inventors: Paul Schmid, Ojai, CA (US); Michael Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 245 days.

(21) Appl. No.: 13/220,091

(22) Filed: Aug. 29, 2011

(65) Prior Publication Data

US 2013/0052913 A1 Feb. 28, 2013

(51) Int. Cl.
*A63H 18/00* (2006.01)

(52) U.S. Cl.
USPC ..... 446/444

(58) Field of Classification Search
USPC ..... 446/444
See application file for complete search history.

(56) References Cited

U.S. PATENT DOCUMENTS

| | | | | |
|---|---|---|---|---|
| 3,359,920 | A | 12/1967 | Iammateo | |
| 3,858,875 | A * | 1/1975 | Nemeth et al. | 273/460 |
| 4,094,089 | A * | 6/1978 | Sano | 446/487 |
| 4,185,409 | A | 1/1980 | Cheng | |
| 4,355,807 | A | 10/1982 | Prehodka | |
| 4,383,688 | A | 5/1983 | Prehodka | |
| 4,423,871 | A | 1/1984 | Mucaro | |
| 4,513,966 | A | 4/1985 | Mucaro et al. | |
| 4,519,789 | A | 5/1985 | Halford et al. | |
| 4,575,350 | A | 3/1986 | Hippely et al. | |
| 4,715,843 | A | 12/1987 | Ostendorff et al. | |
| 4,934,699 | A | 6/1990 | Kaminkow et al. | |
| 5,069,460 | A | 12/1991 | Kulesza | |
| 5,174,569 | A * | 12/1992 | Ngai | 463/63 |
| 5,234,216 | A | 8/1993 | Ostendorff | |
| 5,542,668 | A | 8/1996 | Casale et al. | |
| 6,358,112 | B1 | 3/2002 | Lambert et al. | |
| 7,628,674 | B2 | 12/2009 | Nuttall et al. | |
| 7,690,964 | B2 | 4/2010 | Nuttall et al. | |
| 7,794,301 | B2 | 9/2010 | Ostendorff et al. | |
| 7,819,720 | B2 | 10/2010 | Nuttall et al. | |
| 2005/0191940 | A1 | 9/2005 | Sheltman et al. | |
| 2005/0287919 | A1 | 12/2005 | Sheltman et al. | |
| 2007/0049160 | A1 | 3/2007 | Matthes et al. | |
| 2008/0051001 | A1 | 2/2008 | Nuttall et al. | |
| 2009/0176545 | A1 | 7/2009 | Civettini et al. | |
| 2010/0041305 | A1 | 2/2010 | O'Connor | |
| 2010/0273394 | A1 | 10/2010 | O'Connor et al. | |
| 2010/0291833 | A1 | 11/2010 | O'Connor et al. | |
| 2011/0124265 | A1 * | 5/2011 | O'Connor et al. | 446/429 |

* cited by examiner

*Primary Examiner* — Michael Dennis
(74) *Attorney, Agent, or Firm* — Cantor Colburn LLP

(57) ABSTRACT

A play set for toy vehicles is provided, the play set having: a ramp member pivotally mounted to the play set for movement between a first un-deployed position wherein toy vehicles travelling thereon will be directed under an upper track section and a deployed position wherein vehicles travelling thereon will be launched up into the upper track section; a first mechanism coupled to the ramp member for moving the ramp member between the first position and the second position; and a second mechanism for releasing a floor portion of the upper track section such that toy vehicles located thereon are dropped through an opening in the upper track section, wherein the second mechanism is only actuated after a predetermined number of vehicles are located on the upper track section.

19 Claims, 6 Drawing Sheets

TOY VEHICLE TRACK SET

BACKGROUND

Play sets for toy vehicles are popular toys which are known to provide entertainment and excitement to a user. These play sets typically include a track configuration intended to guide a propelled toy vehicle, such as a 1/64 scale die-cast metal toy vehicle, through a course. The track configurations may include closed-loop continuous track arrangements and open-end arrangements. Toy vehicles are placed on these play set tracks and propelled across the configuration by hand or by an external propulsion means.

To bring increased entertainment and excitement to these play sets, the track configurations may include features such as intersecting tracks, jumps, and other types of track configurations.

Accordingly, it is desirable to provide a track set for toy vehicles that can propel multiple toy vehicles into unique stunt arrangements to provide an enhanced play factor for the user.

BRIEF SUMMARY OF INVENTION

In one embodiment, a play set for toy vehicles is provided, the play set having: a ramp member pivotally mounted to the play set for movement between a first un-deployed position wherein toy vehicles travelling thereon will be directed under an upper track section and a deployed position wherein vehicles travelling thereon will be launched up into the upper track section; a first mechanism coupled to the ramp member for moving the ramp member between the first position and the second position; and a second mechanism for releasing a floor portion of the upper track section such that toy vehicles located thereon are dropped through an opening in the upper track section, wherein the second mechanism is only actuated after a predetermined number of vehicles are located on the upper track section.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
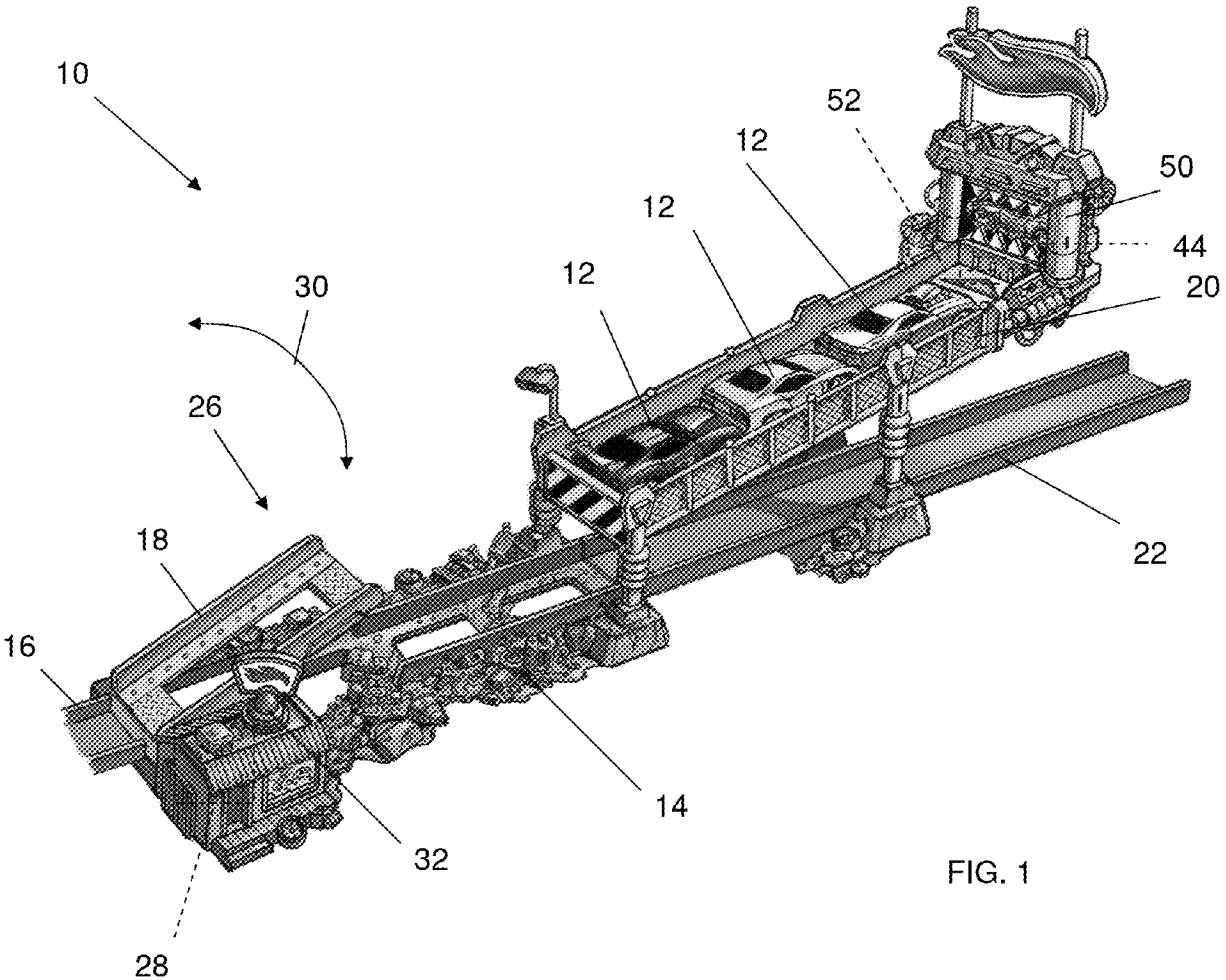
FIG. 1 is a perspective view of a play set according to an embodiment of the invention in a first configuration.

The attached FIGS. illustrate an exemplary play set or track set 10 for toy vehicles or objects 12 according to one non-limiting embodiment of the present invention. The play set 10 includes a base 14, an incoming track segment 16, a ramp member 18, an upper track section 20 and a lower track section 22.

Figure 2:
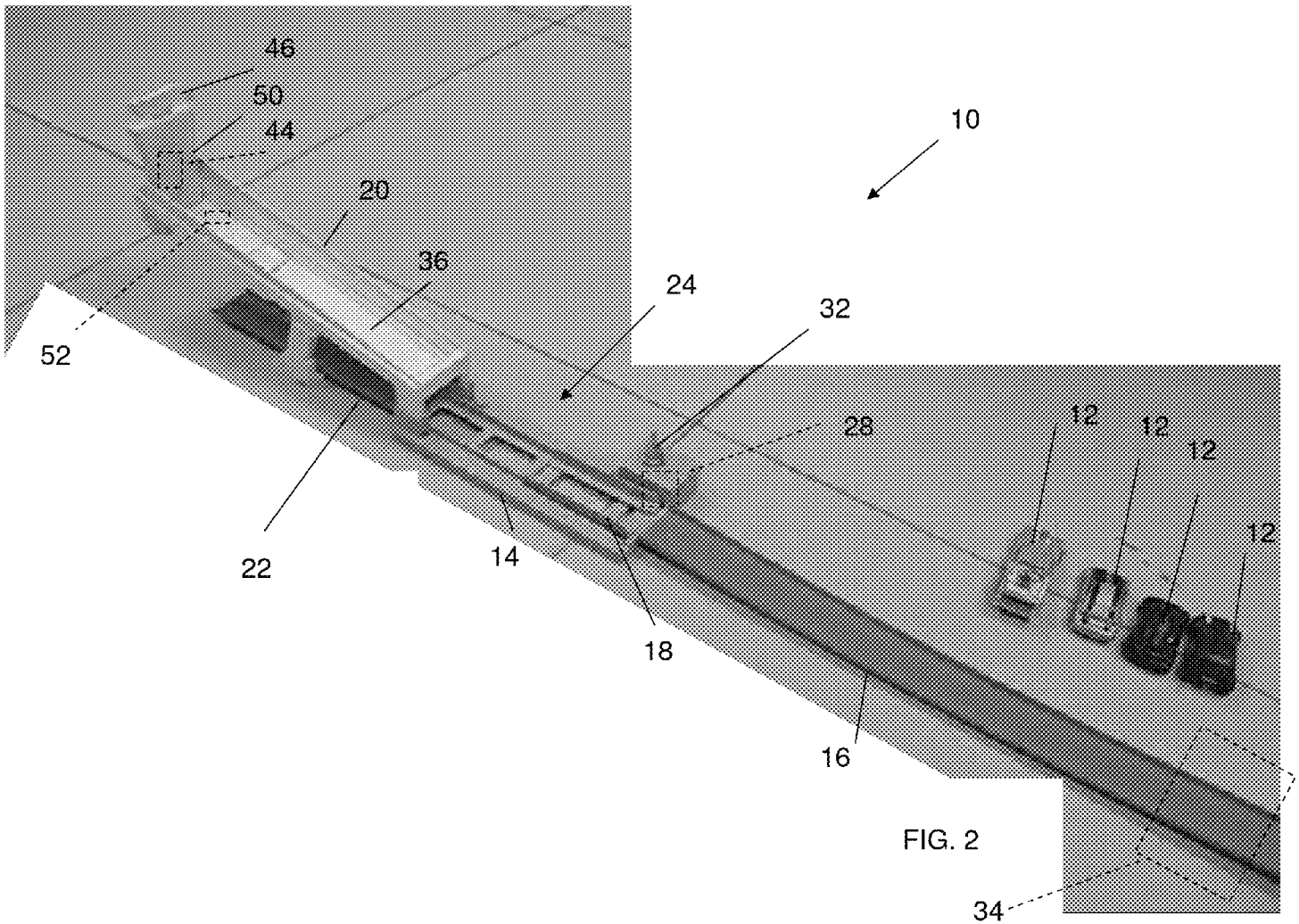
FIG. 2 is a perspective view of the play set according of FIG. 1 in a second configuration.

The ramp member is capable of movement between a first un-deployed position 24 wherein vehicles 12 travelling thereon will be directed into the lower track section 22 (FIG. 2) and a deployed position 26 wherein vehicles 12 travelling thereon will be launched up into the upper track section 20 (FIGS. 1 and 3-6). In one embodiment, ramp member 18 is pivotally mounted to the base and is driven by a spring mechanism 28 that is coupled to the ramp member 18 such that an oscillating upward and downward movement in the direction of arrows 30 is provided to achieve the first and second position of the ramp member 18.

In one embodiment, the spring mechanism 28 is wound by a rotatable key member 32 located on the base member 14. Accordingly and when the spring mechanism 28 is wound up, kinetic energy is applied to ramp member 18 causing it to oscillate between the first and second positions.

In order to launch vehicles 12 onto upper track section 20 a user has to time the movement of the ramp member 18 such that it is in the first position when vehicle 12 reaches the ramp member. Thus, an enhanced play factor is provided wherein the user must time the launching or propelling of their vehicle 12 down the incoming track segment 16. In one embodiment, a user simply pushes the toy vehicles 12 along incoming track segment 16 or alternatively a mechanical launcher 34 such as a spring biased mechanism can be used to propel the vehicles 12 along the incoming track segment 16. Non-limiting examples of suitable launchers are described in U.S. Pat. Nos. 4,108,437 and 6,435,929 and U.S. Patent Publication No. 2007/0293122, the contents each of which are incorporated herein by reference thereto.

Figure 3:
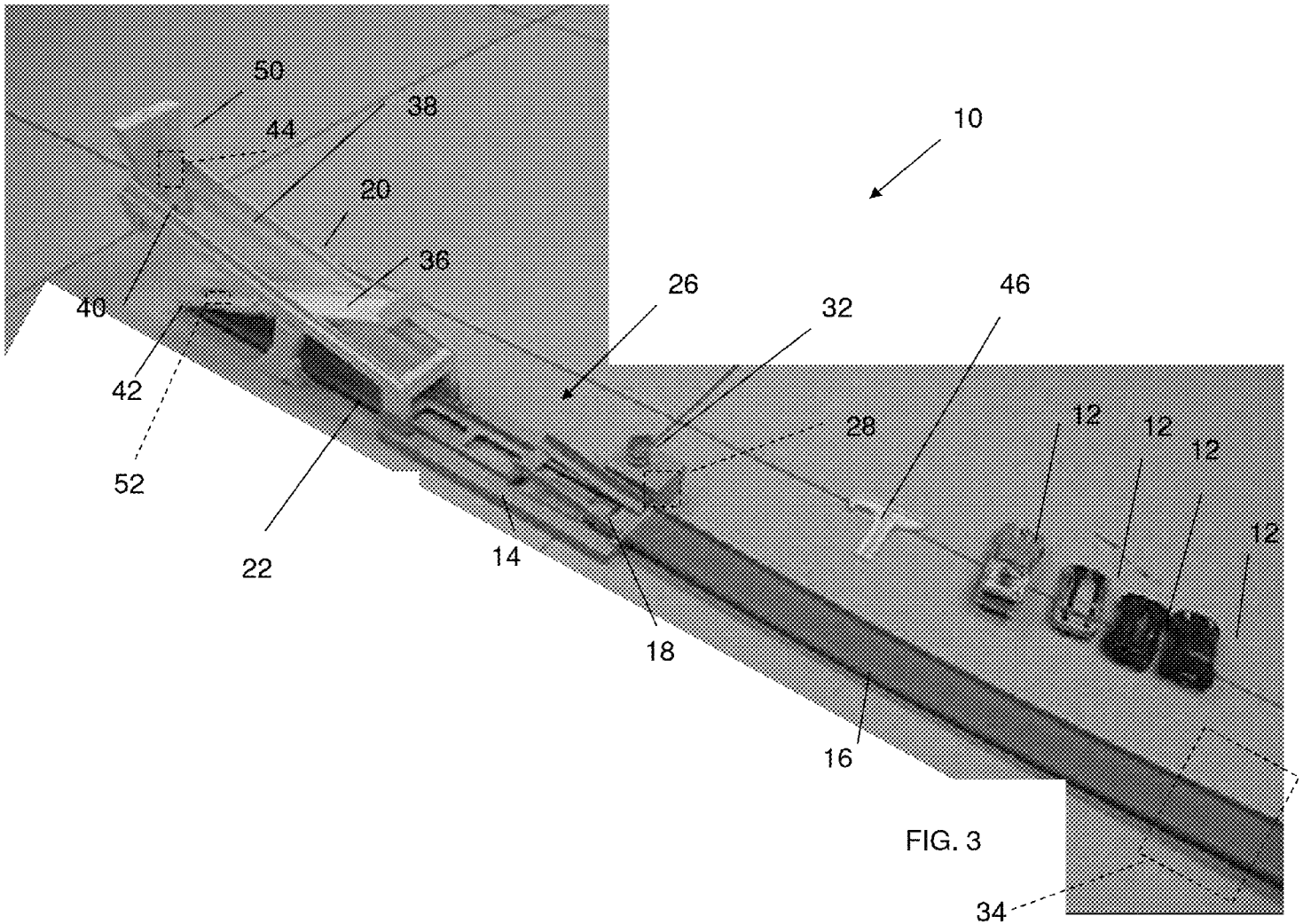
FIG. 3 is a perspective view of the play set according of FIGS. 1-2 in a third configuration.
Figure 4:
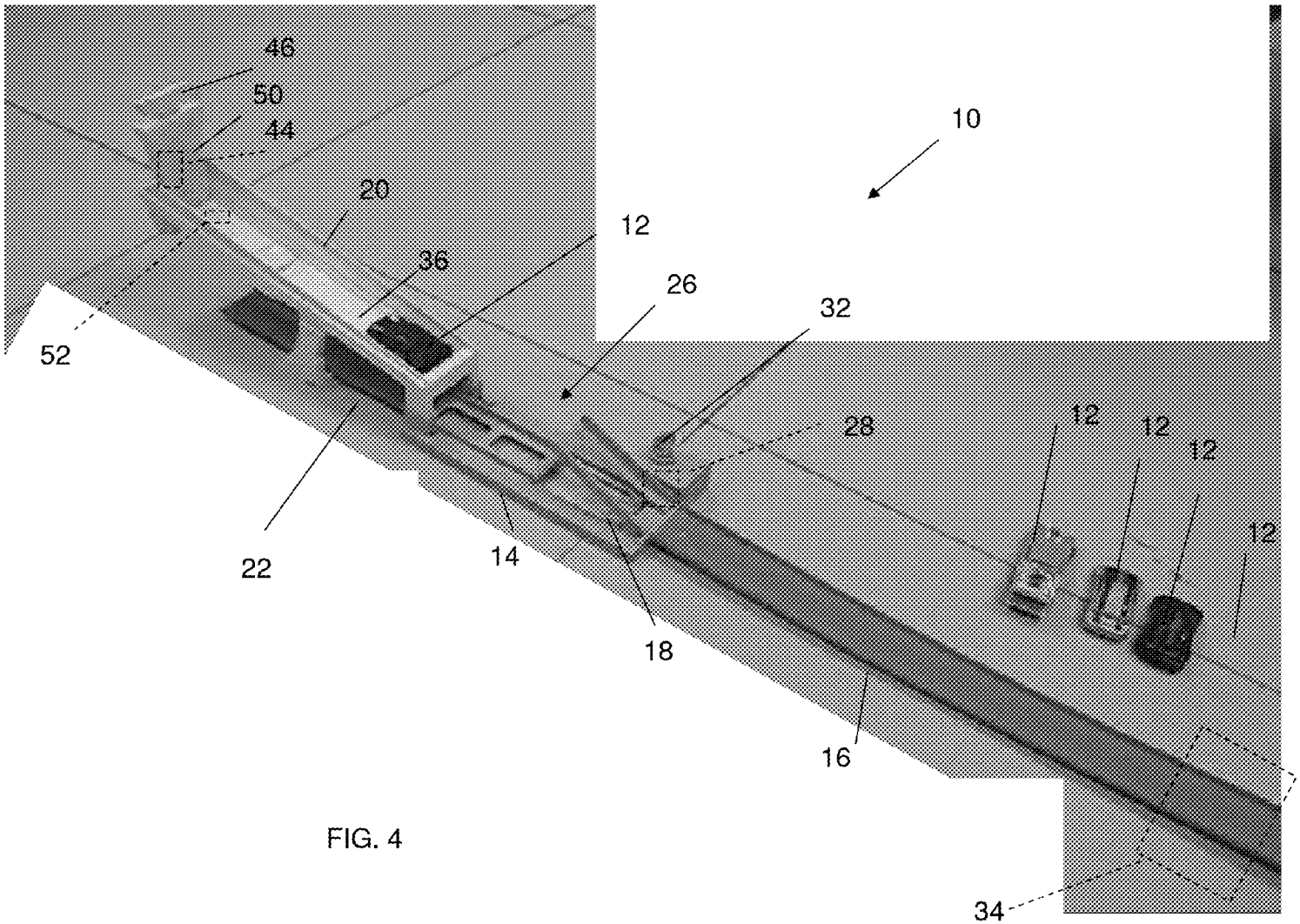
FIGS. 4-6 are perspective views illustrating use of the play set as it translates between the first position, the second position and the third position.
Figure 5:
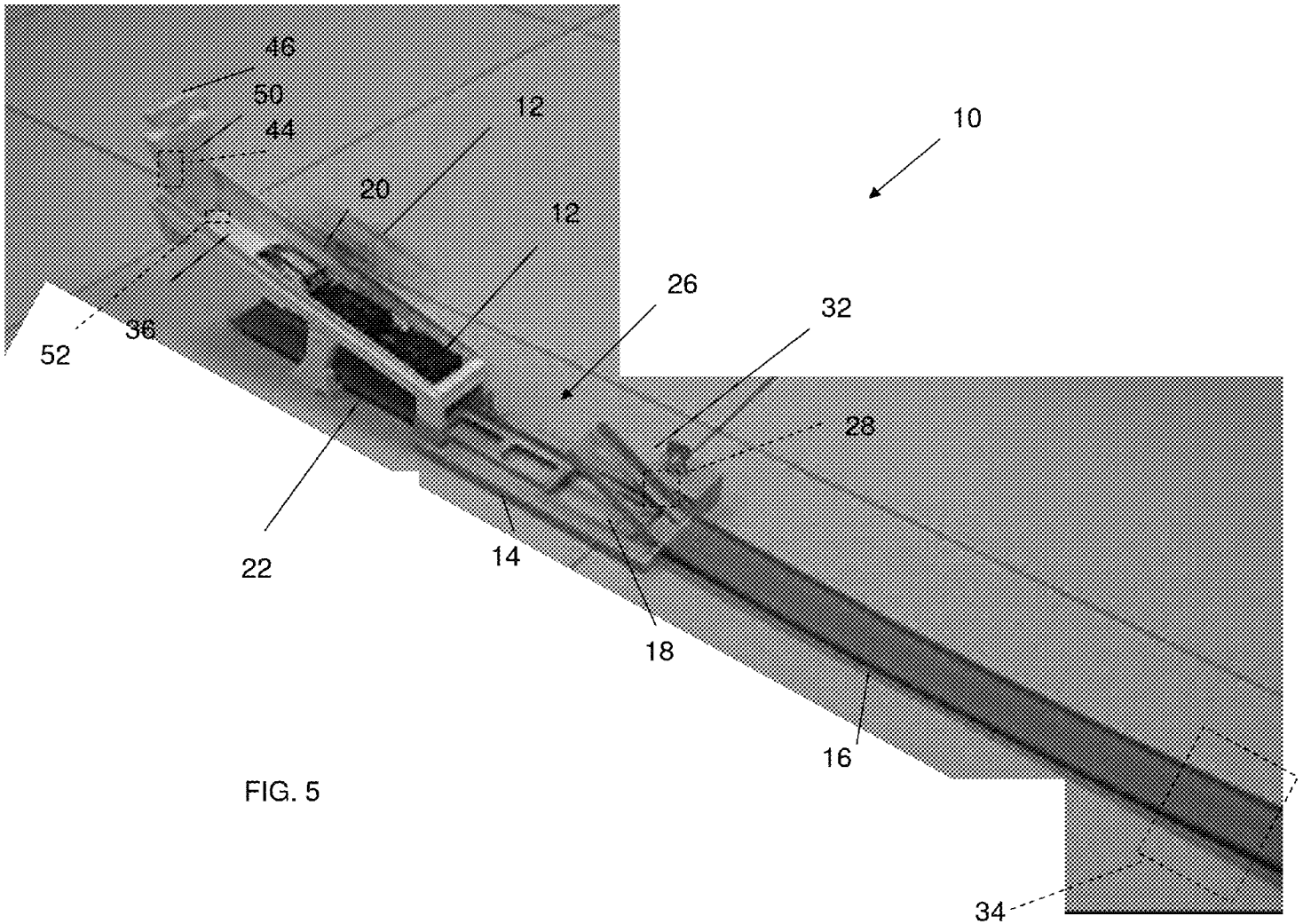
Figure 6:
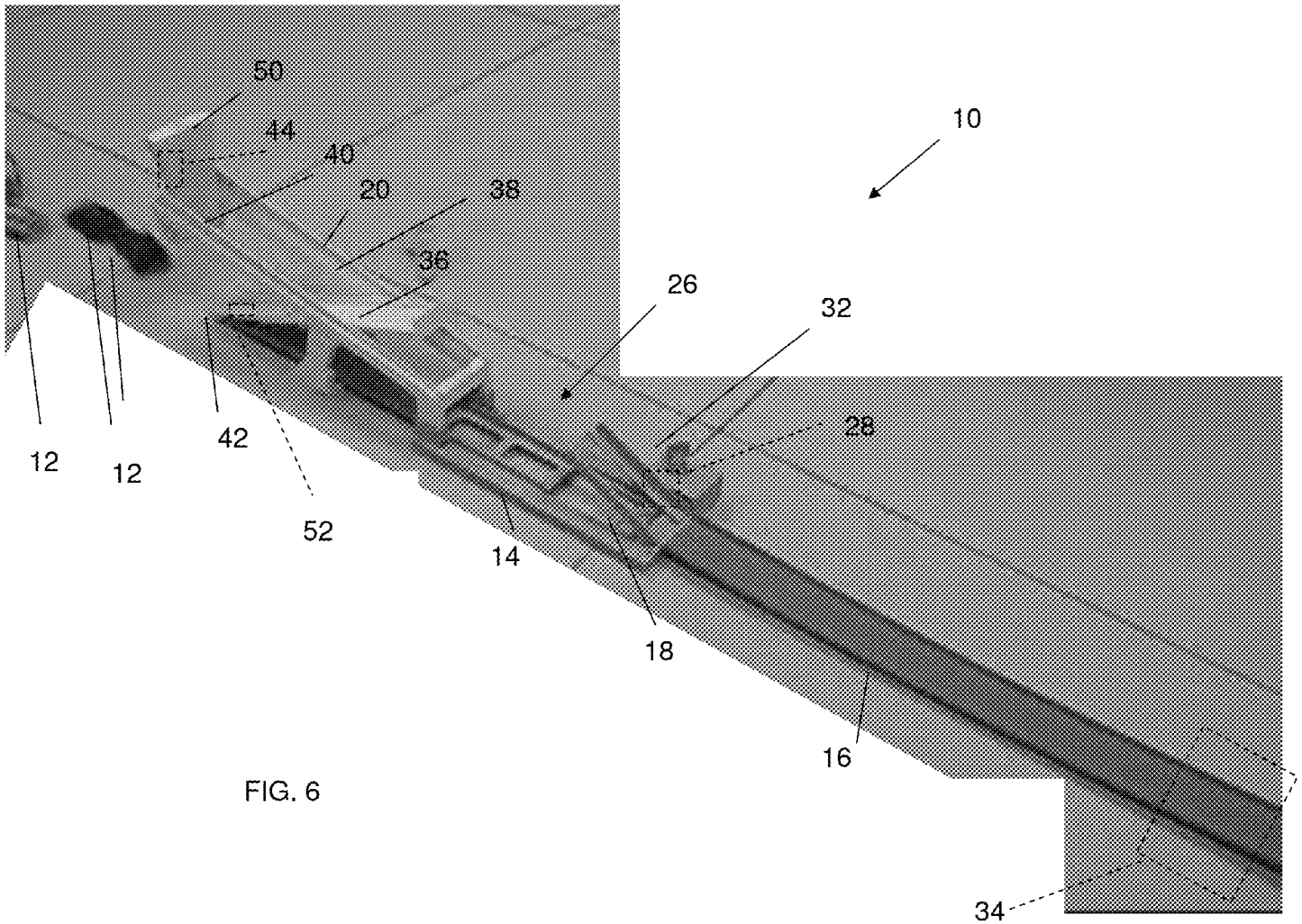

The upper track section 20 has a floor portion 36 that is pivotally secured to the upper track section 20 for movement between an undeployed position illustrated in FIGS. 1, 2, 4 and 5 and a deployed position illustrated in FIGS. 3 and 6. As illustrated and when the floor portion 36 is in the deployed position, the vehicles 12 located thereon will drop through an opening 38 in the upper track section 20.

The upper track section 20 is retained in the undeployed position by a catch or feature 40 configured to engage an end 42 of the floor portion 36. Catch or feature 40 is actuated by a mechanism 44 that has a sensor or actuation switch 46 coupled thereto such that when contact is made with actuation switch 46 or movement is imparted to the same, mechanism 44 releases the floor portion 36 from its undeployed position by moving feature 40 out of engagement with respect to end 42. The aforementioned means for engaging and releasing floor portion 36 is but one non-limiting example and numerous equivalent mechanisms may be employed with various embodiments of the present invention.

During use of the play set a user will attempt to launch a predetermined number of toy vehicles 12 onto the upper track section 20 until the mechanical sensor or actuator 46 of mechanism 44 is contacted and floor portion 36 is released thereby dropping all of the toy vehicles through opening 38. In one exemplary embodiment and in lieu of the mechanism 44 or in combination with mechanism 44, the weight of the toy vehicles themselves will be sufficient to pivot the floor portion from the undeployed position to the deployed position. In still another alternative, the floor portion 36 may be biased into the deployed position by a spring or other equivalent biasing member and actuation of the mechanism releases the biasing force of the spring and allows the floor portion to move to the deployed position. In one non-limiting implementation, the axis about which the floor portion 36 pivots is offset such that a greater portion of the floor portion 36 is located on one side of the axis such that when end 42 is released the floor portion pivots into the deployed position illustrated in the attached FIGS.

In yet another embodiment, the floor portion 36 may contain a release 52 situated near the distal end of the upper track section 20, and configured to activate the mechanism 44. The release 52 is biased in a raised position, which deactivates the mechanism 44, and may be pressed down by the weight of a vehicle, to activate the mechanism 44. The release 52 is situated near the distal end of the upper track section 20, and the track section is titled to encourage vehicles to rest near the proximal end of the upper track section 20. Accordingly, a predetermined number of vehicles must occupy the upper track section 20 for the release 52 to be compressed, activating the mechanism 44. In one configuration, the release 52 is biased by a coil spring, however, various resilient members may be incorporated for biasing the release 52. Of course, numerous other configurations are contemplated to be within the scope of exemplary embodiments of the present invention.

As illustrated in the attached FIGS., the upper track section 20 is capable of holding three vehicles, and the mechanical sensor 46 is located at the distal end of the upper track section 20 and is triggered when a fourth vehicle 12 is launched onto the upper track section 20 due to the majority of the available space on the upper track section being occupied by vehicles 12. Accordingly, this fourth or last vehicle will continue on its trajectory until it hits the mechanical sensor or trigger located at the distal end of the upper track section 20. Of course, the configuration of upper track section 20, the location of sensor 46 and the number of toy vehicles 12 required to be located on the upper track section 20 in order to have the final vehicle actuate the mechanical sensor may vary to be greater or less than those illustrated in the attached FIGS.

In the illustrated embodiment, the mechanical sensor or trigger 46 is located on the face of a "sign" mounted at the end of the upper track section 20 to provide a target for the fourth vehicle to hit. Accordingly, and once the fourth vehicle 12 is launched and successfully reaches the upper track section 20, it strikes the trigger and the floor portion 36 is released. In yet another alternative embodiment, trigger 46 is received within an opening of an end portion 50 of the upper track section 20 and in addition to being coupled to the release mechanism 44 trigger 46 is releasably retained within end portion 50 and a spring biasing force launches trigger 46 from the end portion 50 when it is contacted by the fourth vehicle. Accordingly and in this embodiment and when the trigger 46 is contacted by the fourth vehicle, the trigger 46 will be launched from end portion 50 simulating an explosion or destruction of a 'sign' or a portion of end portion 50 located at the far distal end of the upper track section 20.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" or "in an exemplary embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A play set for toy vehicles, comprising:

a ramp member pivotally mounted to the play set for movement between a first un-deployed position wherein toy vehicles travelling thereon will be directed under an upper track section and a deployed position wherein vehicles travelling thereon will be launched up into the upper track section;

a first mechanism coupled to the ramp member for moving the ramp member between the first position and the second position; and a second mechanism for releasing a floor portion of the upper track section such that toy vehicles located thereon are dropped through an opening in the upper track section, wherein the second mechanism is only actuated after a predetermined number of vehicles are located on the upper track section.

2. The play set as in claim 1, further comprising an incoming track section configured to direct toy vehicles towards the ramp member.

3. The play set as in claim 2, wherein the play set further comprises a launcher for launching vehicles along the incoming track section.

4. The play set as in claim 1, wherein the first mechanism is a spring mechanism wound by a movable member rotatably received on a base portion of the play set.

5. The play set as in claim 4, wherein the second mechanism is located at a distal end of the upper track section remote from the ramp member.

6. The play set as in claim 1, wherein the second mechanism is located at a distal end of the upper track section remote from the ramp member.

7. The play set as in claim 6, wherein the second mechanism is coupled to a feature configured to releasably engage an end of the floor portion.

8. The play set as in claim 1, wherein the floor portion is pivotally and releasably mounted to the upper track section and wherein an axis of rotation of the floor portion with respect to the upper track section is offset from a center of the floor portion.

9. The play set as in claim 1, wherein the second mechanism is actuated by a trigger located on an end portion of the upper track section, wherein the trigger cannot be actuated unless a predetermined amount of vehicles are already located on the upper track section.

10. The play set as in claim 9, wherein the trigger is releasably retained within the end portion and actuation of the trigger causes the trigger to be launched from the end portion of the upper track section.

11. The play set as in claim 10, wherein the trigger is launched from the end portion of the upper track section by a spring biasing force when the trigger is actuated.

12. The play set as in claim 11, further comprising an incoming track segment configured to direct toy vehicles towards the ramp member.

13. The play set as in claim 11, wherein the second mechanism is located at a distal end of the upper track section remote from the ramp member, wherein the second mechanism is coupled to a feature configured to releasably engage an end of the floor portion and wherein the floor portion is pivotally and releasably mounted to the upper track section and wherein an axis of rotation of the floor portion with respect to the upper track section is offset from a center of the floor portion.

14. The play set as in claim 13, further comprising an incoming track segment configured to direct toy vehicles towards the ramp member.

15. The play set as in claim 14, wherein the first mechanism is a spring mechanism wound by a movable member rotatably received on a base portion of the play set.

16. The play set as in claim 1, wherein the second mechanism is located at a distal end of the upper track section remote from the ramp member, wherein the second mechanism is coupled to a feature configured to releasably engage an end of the floor portion and wherein the floor portion is pivotally and releasably mounted to the upper track section and wherein an axis of rotation of the floor portion with respect to the upper track section is offset from a center of the floor portion.

17. The play set as in claim 16, wherein the predetermined number of vehicles is three.

18. The play set as in claim 15, wherein the predetermined number of vehicles is three.

19. The play set as in claim 1, wherein the predetermined number of vehicles is three.

* * * * *